US007914258B2

(12) United States Patent
Spillner

(10) Patent No.: US 7,914,258 B2
(45) Date of Patent: Mar. 29, 2011

(54) FLUID MECHANICAL CONVERTER

(75) Inventor: Robert Spillner, Loef (DE)

(73) Assignee: bionic motion GmbH (DE)

( * ) Notice: Subject to any disclaimer, the term of this patent is extended or adjusted under 35 U.S.C. 154(b) by 5 days.

(21) Appl. No.: 12/175,864

(22) Filed: Jul. 18, 2008

(65) Prior Publication Data

US 2009/0016905 A1 Jan. 15, 2009

Related U.S. Application Data

(63) Continuation of application No. PCT/EP2006/010034, filed on Oct. 18, 2006.

(30) Foreign Application Priority Data

Oct. 19, 2005 (DE) ..... 10 2005 050 055

(51) Int. Cl.
*F04D 33/00* (2006.01)

(52) U.S. Cl. ..... 416/88; 416/89; 416/101; 416/108; 416/110; 416/134 R; 416/135; 416/136

(58) Field of Classification Search ..... 416/79–83, 416/98, 100, 101, 108, 110, 87–89, 134 R, 416/135–137
See application file for complete search history.

(56) References Cited

U.S. PATENT DOCUMENTS

| | | | | |
|---|---|---|---|---|
| 2,050,142 | A * | 8/1936 | White | 416/135 |
| 2,601,495 | A * | 6/1952 | Bell | 416/89 |
| 2,728,298 | A | 12/1955 | Shafer | |
| 3,167,130 | A * | 1/1965 | Day | 416/83 |
| 4,116,585 | A * | 9/1978 | Maracic | 416/135 |
| 4,435,131 | A | 3/1984 | Ruben | |
| 6,050,790 | A | 4/2000 | Chen | |

FOREIGN PATENT DOCUMENTS

| | | |
|---|---|---|
| CH | 493363 | 7/1970 |
| DE | 153810 | 2/1903 |
| DE | 19910731 A1 | 9/2000 |
| EP | 0517249 A2 | 12/1992 |
| EP | 0733168 B1 | 2/1998 |
| EP | 1258637 A1 | 11/2002 |
| FR | 2528500 | 12/1983 |
| GB | 157381 | 5/1922 |
| WO | 0053935 A1 | 9/2000 |

OTHER PUBLICATIONS

International Search Report, Dec. 18, 2006, 6 pages.
Werner Nachtigall et al. BIONA Report 12, Technische Biologie und Bionik 4 (Technical biology and bionics 4), München 1998, 16 Pages.

* cited by examiner

*Primary Examiner* — Christopher Verdier
(74) *Attorney, Agent, or Firm* — St. Onge Steward Johnston & Reens LLC

(57) ABSTRACT

The present teachings relate to a fluid mechanical converter having at least one energy-accumulator mass system that can be powered by a power drive. To provide a fluid mechanical converter, which improves overall efficiency using the simplest components, it is proposed according to the present teachings that the displacement of the driven energy accumulator-mass system is overlaid with a displacement that is caused by at least one inertial force.

16 Claims, 5 Drawing Sheets

POSITION "O"

POSITION "u"

$\alpha_{max} > \alpha < \alpha_0$ $\alpha_{min} < \alpha < \alpha_0$

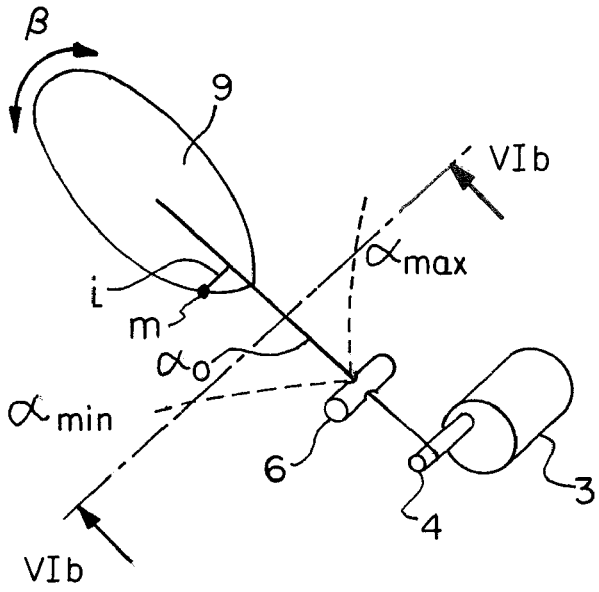
Fig. 6a
Fig. 6b
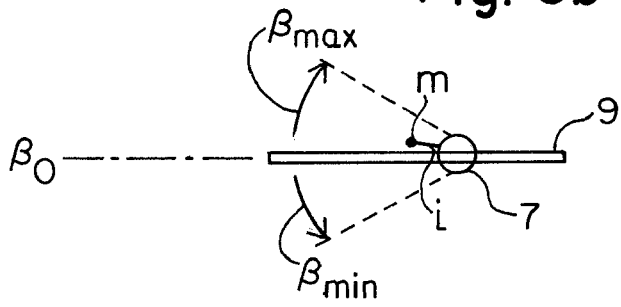
Fig. 6c
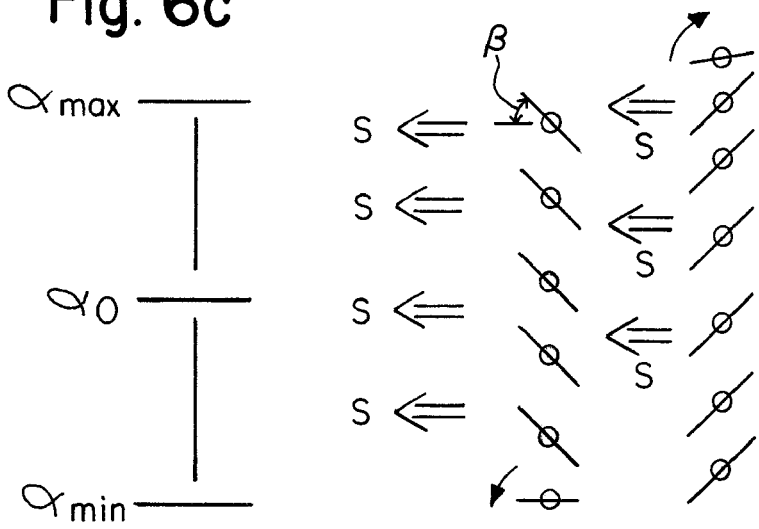

FLUID MECHANICAL CONVERTER

CROSS-REFERENCE TO RELATED APPLICATIONS

The present application is a continuation of pending International patent application PCT/EP2006/010034 filed on Oct. 18, 2006 which designates the United States and claims priority from German patent application 10 2005 050 055.2 filed on Oct. 19, 2005, the content of which is incorporated herein by reference.

FIELD OF THE INVENTION

The invention relates to a fluid mechanical converter having at least one energy-accumulator mass system. The aim of the invention is to provide a fluid mechanical converter, which improves overall efficiency using the simplest components. To achieve this according to the invention, the displacement of the driven energy accumulator-mass system is overlaid with a displacement that is caused by at least one inertial force.

BACKGROUND OF THE INVENTION

The invention relates to a fluid mechanical converter having at least one energy-accumulator mass system that can be powered by a power drive.

A generic fluid mechanical converter is known, for example, from *BIONA report* 12 (Gustav Fischer Publishers, Stuttgart, 1998). In this publication on the occasion of the Fourth Bionic Congress 1998 in Munich, Hans Scharstein, in a paper entitled title "Balance of Force and Power in Artificial Wing Motion of Individual Insect Wings," describes a piezo wing power drive. In this familiar device, a propeller is rotatably mounted on a piezo flexion element, which as a first spring-mass system, executes a striking motion, where the powering of the first spring-mass system advantageously occurs in resonance. To make possible a continual fluid stream to one side, the batting arm that forms the second spring-mass system is rotated passively against a rotary spring by the emerging air forces. As a result of this arrangement, a rotation of the propeller is introduced at every turnaround point of the oscillating motion.

As a result of the inertia of the batting arm and of the small air forces in the turnaround points, this rotation occurs with a delay, so that the batting arm is not yet in optimal rotation position shortly after the turnaround point of the strike swiveling. Consequently the total degree of effectiveness of the device is reduced.

WO 00/53935 A1 reports a device for producing a fluid stream, in which device a wing element mounted on a rotation body can be converted into a first up-and-down motion by means of the resonator that powers the rotation body. For simulating the striking motion of an insect wing, this known device comprises an additional power unit that is indirectly coupled with the wing element and by means of said unit a second motion, namely a rotation of the wing element, can be wound up around its longitudinal axis and is overlaid on the first up-and-down motion of the wing element.

Through the use of two separate power drives for producing the two oscillating motions of the wing element overlaid on one another, this device is very complex in terms of construction and control technology.

In addition, a device configured as a fluid mechanical converter (FMC) with a non-rotary motion that is, for example, with oscillating parts, is known for instance from EP 0 733 168 B1, and concerns a ventilator for distributing generated heat of an appliance. The ventilator comprises a flexible wing element that has first and second ends and is powered by electromagnetic forces, so that the position of the wing element is constantly monitored by a Hall effect appliance. Fluid machines of this type are complex in terms of the adjustment device and are characterized by simply constructed moving mechanical parts, which operate with only minor losses. The wing element, on the other hand, operates with a low aerodynamic degree of effectiveness because the fluid effect breaks down very early because of the uncontrolled motion of the wing element. The energy transmission from the wing element to the surrounding fluid is prone to severe losses, and thus the overall degree of effectiveness of the ventilator is poor and the effect in addition can be loud noises during operation.

In addition, in EP 0 517 249 A2, a device is described which produces a two-dimensional flow of a fluid with a high efficiency and low noise levels by imitating the buzzing of bees with a special mechanism. Devices of this type are distinguished by a high aerodynamic effectiveness because the flow continues longer. Less advantageous are the more complex structure of the power shaft and the related high friction of the power joints, the relatively high noise build-up and the structural size of the device.

It is consequently the object of the present invention to create a fluid mechanical converter of the aforementioned type, which improves the total degree of effectiveness while using the simplest components.

SUMMARY OF THE INVENTION

This object is fulfilled, according to the invention, in that the motion of the powered energy accumulator-mass system is overlaid by a motion caused by at least one mass force.

The additional impact of at least one mass force on the motion of the energy accumulator mass system powered by the power drive causes a constantly optimal start-up of the energy accumulator-mass-system with minimization of the fluid losses. Advantageously, the energy accumulator of the energy accumulator-mass systems is configured as a spring.

Alternatively to the configuration of the spring-mass system, it is of course also possible to configure the energy accumulator of the energy accumulator-mass system as, for instance, a cylinder-piston device filled with compressed gas.

According to a special embodiment of the invention, it is proposed that the powered spring-mass system can be brought into resonant oscillation through the power drive. In this type of powering, only the components' own damping of the spring-mass system can be compensated energetically as a loss by means of the powered spring-mass system.

With a practical embodiment of the invention, it is proposed that the power drive should be configured as an additional spring-mass system, which according to a special embodiment of the invention, can be powered in resonance. Through the operation of the spring-mass system that serves as a power drive, the power loss in the resonance area is minimal because only the components' own damping are to be compensated energetically as losses and no inert forces increase the power uptake.

According to a special embodiment of the invention, it is proposed that the powered spring-mass system can be brought into resonant oscillation through the spring-mass powering system that is operated in resonance. In this type of operation, in the final analysis only the components' own damping of both spring-mass systems are to be compensated energetically as losses. The operation of the two spring-mass systems in the resonant area can, according to the invention, be designed in such a way that the powering first and the powered second spring-mass system correspond to one another with respect to their resonant frequencies, or else each oscillates at an individual resonant frequency.

With the mass that causes the mass power-induced motion of the spring-mass system, according to the invention this could be the mass of the components that form the second spring-mass system or on the other hand it can be an additional mass that can be affixed on the second spring-mass system. In both cases, the at least one mass power causes an additional, overlaid motion of the second spring-mass system, if the mass engages around a lever arm displaced to a motion axis on the second spring-mass system.

To provide a flexibly usable fluid mechanical converter, it is further proposed with the invention that the fluid mechanical converter should be capable of being driven reversibly, that is, that the possibility exists to drive the first spring-mass system by means of the second spring-mass system. Advantageously, for this purpose, the second spring-mass system is first set in motion by the first spring-mass system. If the second spring-mass system happens to be in an air current, then aerodynamic forces which can be used as power force for the first spring-mass system constantly act on the second spring-mass system; that is, the power forces drive the first spring-mass system.

According to a practical embodiment of the invention, it is proposed that the first spring-mass system should be capable of being driven by a mechanically powered eccentric tappet. This configuration of the mechanical power drive is characterized by a simple structure that is not particularly subject to power outages.

According to the invention, the first spring-mass system consists of a flexion spring that is supported in a mounting sleeve and on the one hand is mounted on an eccentric stud of the eccentric tappet and on the other hand is weighted with a mass so that the mass acting on the flexion spring, according to an advantageous embodiment, is configured as a swivel arm mounted on the free end of the flexion spring with a wing element mounted in it so that it can swivel rotationally.

To cause a rotation of the wing element by means of the oscillating/strike motion of the flexion spring, the wing element and the swivel arm are in active connection with one another by means of a torsion spring. For this purpose, according to a practical embodiment of the invention, it is proposed that the torsion spring is positioned inside a sleeve shaft that in turn on one side is mounted in the swivel arm. The torsion spring in turn is attached on the swivel arm by a casing with one end and with the other end is attached on the sleeve shaft by an end casing.

To produce the active connection, determined by the torsion spring, between the wing element on the one hand and the swivel arm on the other hand, it is proposed that the wing element should be mounted on the sleeve shaft by the end casing.

The torsion spring, in connection with the masses of the wing element, end casing, and sleeve shaft, thus constitutes the second spring-mass system of the inventive energy converter.

Finally, it is proposed with the invention that a center line of the sleeve shaft, on which the wing element is mounted on the sleeve shaft, should run parallel to the axis of symmetry of the wing element. Through this axle realignment, the passive rotation of the wing element is set in motion by the air power.

The inventive device has the advantage of a heightened degree of effectiveness, simple structure owing to the use of simple components, and reduction of the noise level. By using two elastic elements between the power drive shaft and the wing element, the total degree of effectiveness is improved and the two oscillating motions of the wing element operate more harmonically. High momentum and forces that arise in the turnaround points of the wing element are thus reduced to a minimum, so that the noise level is clearly reduced. The device in addition is of simple construction and compact in terms of space requirements.

Additional characteristics and advantages of the invention can be seen from the appended illustrations, in which an embodiment of an inventive fluid mechanical converter is depicted in merely exemplary terms.

BRIEF DESCRIPTION OF THE DRAWINGS

FIG. 6*a* shows a schematic view of the course of the motion of the wing element of FIG. 1.

FIG. 6*b* shows a section along the line VIb-VIb of FIG. 6*a*.

FIG. 6*c* shows a schematic view of the rotation of the wing element depending on the angle of oscillation $\alpha$.

DETAILED DESCRIPTION OF THE INVENTION

Figure 1:
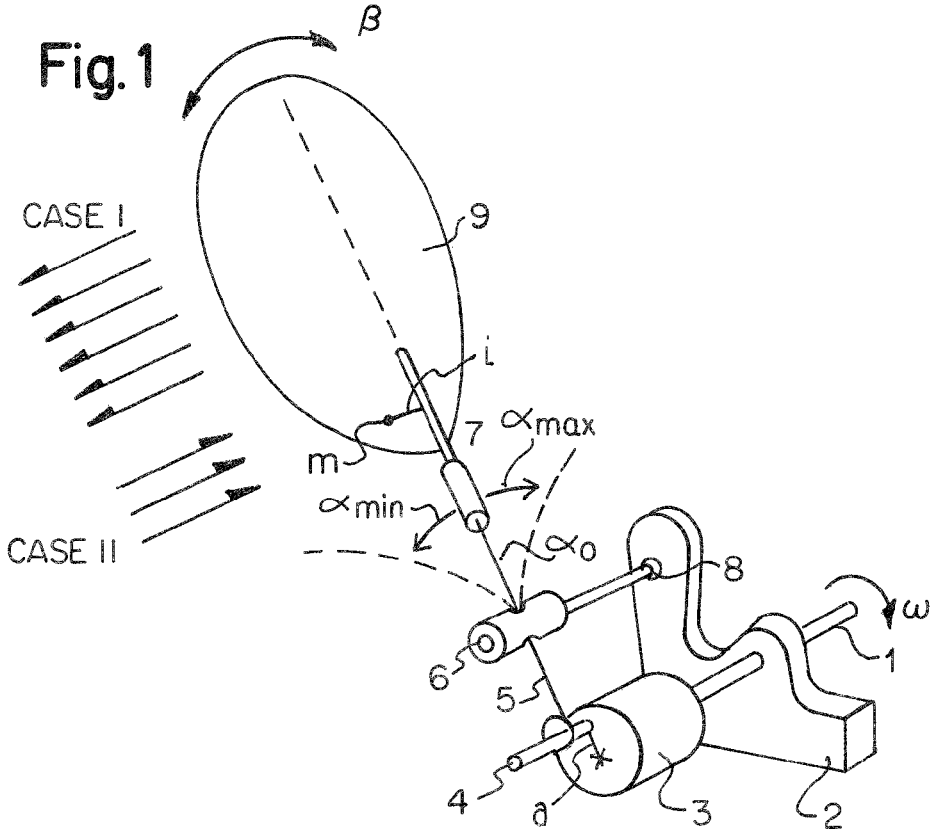
FIG. 1 shows a schematic depiction of the structure of an inventive fluid mechanic converter.

FIG. 1 shows the schematic structure of a fluid mechanic converter (FMC). Through a shaft 1 that is powered with the angular velocity $\omega$ and is mounted in a mounting unit 2, mechanical energy is transmitted rotationally onto an eccentric tappet 3. At a distance "a" from the point of rotation of the eccentric tappet 3, a stud 4 is affixed on the eccentric tappet 3. Mounted on the stud 4 is a flexion spring 5, which is connected, supported in a mounting sleeve 6, on its free end with a swivel arm 7. The mounting sleeve 6 in turn is mounted rotatably on an axle 8, which is connected rigidly with the mounting unit 2. Through the rotation of the eccentric tappet 3 and the supporting mounting of the flexion spring 5 in the mounting sleeve 6, the free end of the flexion spring 5 that is connected with the swivel arm 7 is set in oscillating motions, so that the swivel plane runs parallel to the longitudinal axis of the mounting unit 2.

Alternatively to the power drive of the eccentric tappet 3 shown in FIG. 1 by means of the shaft 1, it is also possible of course to power the eccentric tappet 3 in other ways, for instance by a push-rod connected with an additional eccentric disc or by toothed wheel drive that engages with the eccentric tappet 3.

Inside the swivel arm 7, a wing element 9 is rotationally mounted. The flexion spring 5 and swivel arm 7 with the wing element 9 constitute a first spring-mass system, which is periodically activated by the rotation of the eccentric tappet 3. The swivel arm 7 and the wing element 9 thereby oscillate around the mounting sleeve 6 at the angle $\alpha$.

The angular velocity ω of the eccentric tappet 3 is advantageously selected in such a way that it corresponds closely or precisely to the resonant frequency of the flexion spring 5 and to the swivel arm 7 with the wing element 9. As a result, the angle α of rotation is of maximal size.

As a result of operating in the resonant area, the lost capacity is minimal because only the components' own damping has to be compensated energetically and no inert forces increase the capacity use. By using the elastic flexion spring 5, moreover, the oscillation of the wing element 9 is more harmonious. High momentum and forces that arise in particular at the turnaround points of the wing element 9 are thus reduced to a minimum, so that the noise level is clearly reduced.

Figure 2:
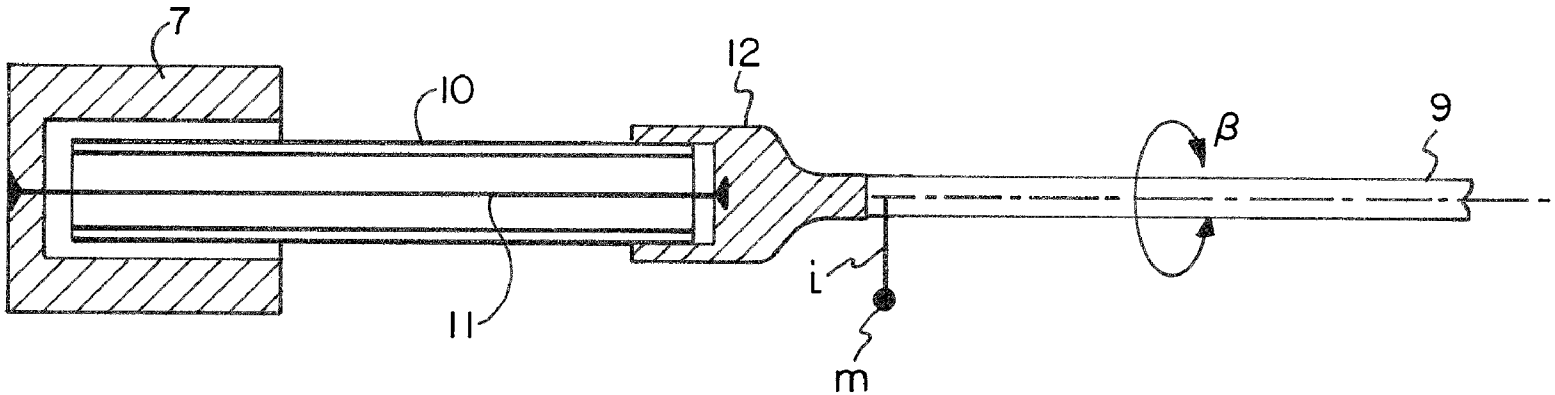
FIG. 2 shows an enlarged schematic depiction of detail 11 of FIG. 1.

The mounting of the wing element 9 on the swivel arm 7 is shown in detail in FIG. 2. Inside the swivel arm 7 there is a sleeve shaft 10 mounted, in which a torsion spring 11 is located which is connected firmly with the end casing 12 on one side of the sleeve shaft 10. The other end of the torsion spring 11 is firmly connected with the swivel arm 7. The wing element 9 in turn is affixed onto the sleeve shaft 10 by the end casing 12.

If the wing element 9 rotates around the β angle, then a counter-momentum acts on the wing element 9. The torsion spring 11 forms a second spring-mass system in combination with the masses of the wing element 9, of the end casing 12, and of the sleeve shaft 10.

The wing element 9 oscillates around the center axis of the swivel arm 7 at an angle β. This system is also activated by the motion of the flexion spring 5. The resonant frequency is selected in such a way that it corresponds approximately or exactly to the angular velocity ω of the eccentric tappet 3. As a result, a modification of the rotation of the wing element 9 already occurs in the immediately area of the upper and lower turnaround points and the total degree of effectiveness of the flow fluid mechanical converter improves.

Figure 3:
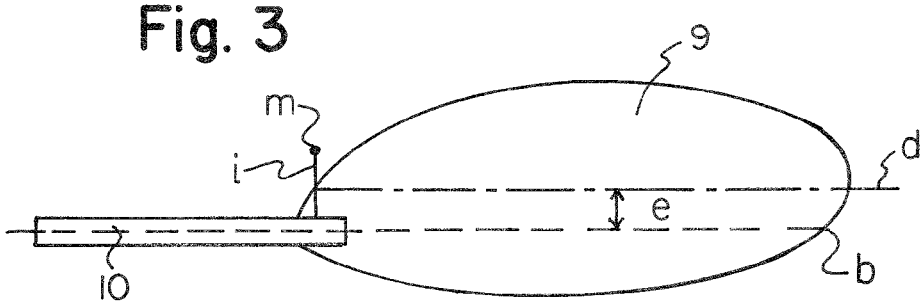
FIG. 3 shows a detail view of the wing element of FIG. 1.

FIG. 3 shows an overhead view of the wing element 9 with the sleeve shaft 10. The extension of the center line "b" of the sleeve shaft 10 runs here at a distance "c" parallel to the axis of symmetry "d" of the wing element 9. Because of this displacement of the axis, the passive rotation of the wing element 9 is triggered by the aerial forces. The active rotation of the wing element 9 is triggered by the mass "m," which is set off by the lever arm "i" from the center line "b" of the sleeve shaft 10, so that the center line "b" of the sleeve shaft 10 forms the axis of motion (axis of rotation) of the wing element 9.

The mass point "m," shown in particular in FIGS. 1 through 3, can, on the one hand, schematically depict the entire mass of the wing element 9 and of the swivel arm 7, or on the other hand can be configured as an additional mass that can be attached to the second spring-mass system.

In the fluid mechanical converter shown in FIG. 1 it is possible to distinguish in theory between two different types of operation.

Case I: The mechanical power drive of the device makes use of the shaft 1. The mechanical energy of the shaft 1 is transmitted onto the wing element 9, minus the friction losses. The wing element 9 in turn transmits this energy to a fluid as fluid energy.

Case II: If fluid energy is applied continuously to the wing element 9, then this energy minus the friction losses is diverted as mechanical energy to the shaft 1. For this purpose the fluid mechanical converter is placed in an air stream and is first driven simultaneously to the power shaft 1 with a constant angular velocity ω close or equal to the resonant frequency of the two rotary forces α and β. As soon as the two oscillations run constantly, mechanical energy can be drawn off on the shaft 1 and the device continues running on its own power. The power drive makes use of air forces forming on the wing element 9 that can be diverted energetically on the shaft 1.

A fluid mechanical converter of the type illustrated can thus be powered reversibly.

Figure 4A:
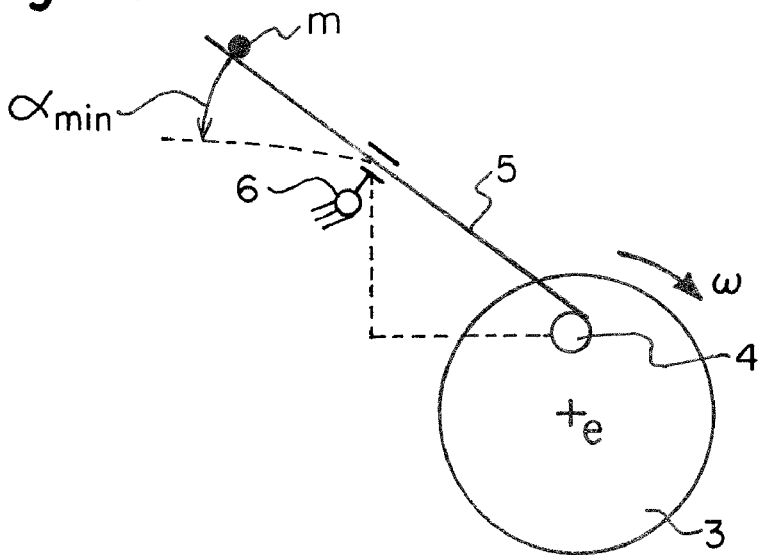
FIG. 4*a* shows a schematic depiction of the kinematic and aerodynamic motions of the flexion spring of FIG. 1, showing the eccentric stud in an upper position.
Figure 4B:
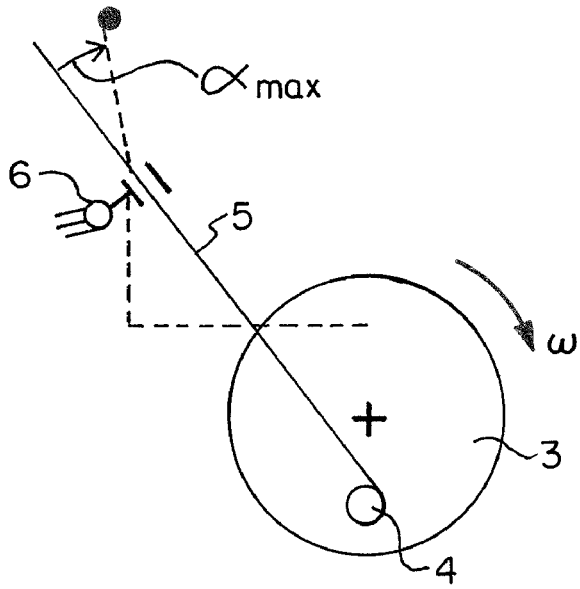
FIG. 4*b* shows a depiction according to FIG. 4*a* but with the eccentric stud in a lower position.

FIGS. 4*a* and 4*b* show the kinematic and dynamic motions of the flexion field 5 on the basis of the rotation of the eccentric tappet 3 with constant angular velocity X around a center point "e."

FIG. 4*a* shows the flexion spring 5 and the stud 4 that is in the "o" position. The entire mass of the wing element 9 and of the swivel arm 7 is depicted in this illustration as mass point "m." In this position the vertical velocity component of the stud 4 is precisely zero and the flexion line of the flexion field 5, as a result of the inert forces of the mass "m," assumes the course indicated with broken lines and is diverted at the angle $\alpha_{min}$.

FIG. 4*b* shows the path of the flexion spring 5 if the stud 4 runs through the position "u." In this position the vertical velocity component of the stud 4 is again precisely zero and the result if a dynamic modification of the flexion line of the flexion field 5, which is shown in broken lines diverted by the angle $\alpha_{max}$.

Figure 5A:
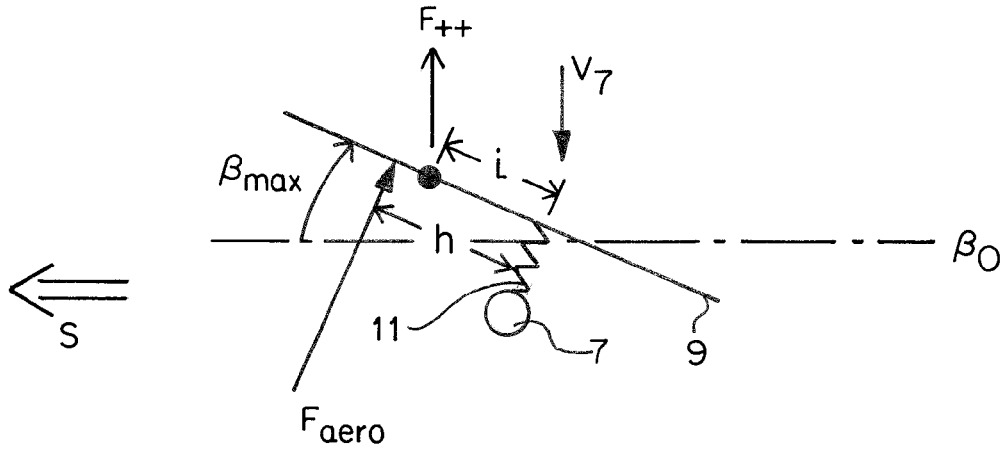
FIG. 5*a* shows a schematic view of the forces and momentum acting on the wing element of FIG. 1, showing an acceleration from above downward.
Figure 5B:
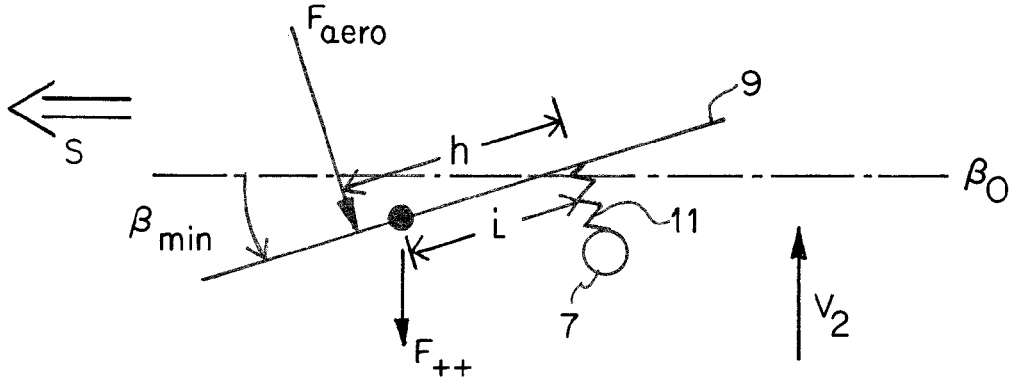
FIG. 5*b* shows a depiction according to FIG. 5*a* but with the reverse acceleration, from below upward.

FIGS. 5*a* and 5*b* show a schematic view of the forces and momentum that act on the wing element 9.

FIG. 5*a* shows schematically the impacting forces and momentum that act on the wing element 9, the swivel arm 7, and the torsion spring 11. The motion of the wing element 9, which corresponds to the arrow VI, accelerates from upward to downward in the angle area of the oscillating motion $\alpha_{max}>\alpha>\alpha_0$. If the unsteady effects of the flow are neglected, then two power components for the rotation of the wing element 9 are existent by the amount $\beta_0$. One power component is the aerodynamic force $F_{aero}$, which acts with the lever arm "h" on the longer side of the wing element 9. The second power is the mass inert force $F_{tr}$ of the wing element and of the mass "m" as well as of the masses of the sleeve shaft 10, torsion spring 11, and the end casing 12 that rotate together, which is effective on the lever length "i." Both power components stimulate the spring-mass system, which is made up of the wing element 9 and torsion spring 11. The resulting fluid motion occurs in the direction of the arrow S.

FIG. 5*b* shows the reverse case, when the motion of the wing element 9 is accelerated from down to up corresponding to the direction of the arrow $V_2$. The power components $F_{tr}$ and $F_{aero}$ act contrary to those of FIG. 5*a*. Because of the angle $\beta_{min}$ of the wing element, however, the fluid motion also occurs as shown in FIG. 5*a*, from left in the direction of the arrow S.

The direction of the fluid motion is thus independent of the particular direction of motion of the wing element 9.

FIG. 6*a* shows the course of motion of the wing element 9. In this schematic illustration the two different oscillating motions α and β are depicted. Here the angle β describes the rotation of the wing element 9 around the center axis of the swivel arm 7, while the angle α describes the rotation of the flexion spring 5 around the mounting sleeve 6. Starting from the stationary position $\alpha_0$, the wing element 9 runs through the turnaround points $\alpha_{max}$ and $\alpha_{min}$.

FIG. 6*b* shows the wing element 9 in a section across the longitudinal axis with the amplitude angles $\beta_{max}$ and $\beta_{min}$.

FIG. 6*c* shows the end of the rotation of the wing element 9 in relation to the oscillating or striking angle α. The wing element 9 moves at accelerated pace from $\alpha_{max}$ by way of $\alpha_0$ to $\alpha_{min}$, from above to below. As already described in FIGS.

5*a* and 5*b*, the wing element 9 is rotated by the angle β by the inert forces $F_{tr}$ and aerial force $F_{aero}$. The exiting fluid flow moves from left in the direction of the arrow S. In the area of $\alpha_{max}$ to $\alpha_0$, the torsion spring 11 is pre-tensed by the attacking forces. In the area $\alpha_0$ to $\alpha_{min}$, the inert power $F_{tr}$ changes direction and causes a reduction of the oscillation or rotation angle β.

Near $\alpha_{min}$, the aerial forces $F_{aero}$ are relatively small and the angle β is again reduced. In addition, at this point, because of the torsion spring 11 pretenses from the resting position $\beta_0$, additional rotary energy is released, which causes an oscillation of the wing element 9 in the area $\alpha_{min}$. As a result, the wing is already upward in the next striking motion in the geometrically correct position and in its continuing course is rotated back into the opposite direction through the inert forces $F_{tr}$ and aerial forces $F_{aero}$. Here again the result is a fluid motion toward the left in the direction of the arrow S. In the upper turnaround point $\alpha_{max}$, there now begins, similarly as in the lower turnaround point $\alpha_{min}$, a reverse rotation of the wing element 9 into the neutral position and a slight over-oscillation of the wing element 9 in the direction toward $\beta_{min}$.

The invention claimed is:

1. A fluid mechanical converter having at least one energy-accumulator mass system that can be powered by a power drive wherein the motion of the powered energy-accumulator mass system is overlaid by a motion that is caused by at least one mass force, wherein the energy-accumulator system is configured as a first spring-mass system, wherein the power drive is a second spring-mass system, wherein the second spring-mass system serving as the power drive can be driven by a mechanically driven eccentric tappet, and wherein the second spring-mass system serving as the power drive consists of a flexion spring that is supported in a mounting sleeve and on the one hand is mounted on a stud of the eccentric tappet and on the other hand is weighted with a mass.

2. A fluid mechanical converter according to claim 1, wherein the powered first spring-mass system can be brought into resonant oscillation by the power drive.

3. A fluid mechanical converter according to claim 1, wherein the second spring-mass system serving as the power drive can be driven in resonance.

4. A fluid mechanical converter according to claim 3, wherein the powered first spring-mass system can be brought into resonant oscillation by the second spring-mass system serving as the power drive.

5. A fluid mechanical converter according to claim 4, wherein the first and second spring-mass systems correspond to one another in terms of their resonant frequencies.

6. A fluid mechanical converter according to claim 1, wherein the at least one inertial force can be produced by the mass of the components that make up the second spring-mass system.

7. A fluid mechanical converter according to claim 1, wherein the at least one inertial force can be produced by an additional mass that can be attached to the second spring-mass system.

8. A fluid mechanical converter according to claim 6, wherein the mass, displaced by a lever arm, engages with a motion axis on the second spring-mass system.

9. A fluid mechanical converter according to claim 1, wherein in the fluid mechanical converter can be driven reversibly.

10. A fluid mechanical converter according to claim 1, wherein the mass acting on the flexion spring is configured as a swivel arm mounted on the free end of the flexion spring and having a wing element mounted in the swivel arm that can swivel rotationally.

11. A fluid mechanical converter according to claim 10, wherein the wing element and swivel arm are in active connection with one another by means of a torsion spring.

12. A fluid mechanical converter according to claim 11, wherein the torsion spring is positioned inside a sleeve shaft that in turn is mounted in the swivel arm.

13. A fluid mechanical converter according to claim 12, wherein the torsion spring attached with one end on the swivel arm and with the other end on the sleeve shaft by means of an end casing.

14. A fluid mechanical converter according to claim 13, wherein the wing element is mounted on the sleeve shaft by means of the end casing.

15. A fluid mechanical converter according to claim 13, wherein the torsion spring in connection with the masses of the wing elemental, the end casing, and the sleeve shaft make up the first spring-mass system driven by the power drive.

16. A fluid mechanical converter according to claim 13, wherein a center line of the sleeve, on which the wing element is mounted on the sleeve shaft, runs parallel at a distance to the axis of symmetry of the wing element.

* * * * *